US008456388B2

(12) United States Patent
Roberts et al.

(10) Patent No.: US 8,456,388 B2
(45) Date of Patent: Jun. 4, 2013

(54) SYSTEMS AND METHODS FOR SPLIT PROCESSOR CONTROL IN A SOLID STATE LIGHTING PANEL

(75) Inventors: John K. Roberts, Grand Rapids, MI (US); Keith J. Vadas, Coopersville, MI (US)

(73) Assignee: Cree, Inc., Durham, NC (US)

( * ) Notice: Subject to any disclaimer, the term of this patent is extended or adjusted under 35 U.S.C. 154(b) by 998 days.

(21) Appl. No.: 11/674,855

(22) Filed: Feb. 14, 2007

(65) Prior Publication Data

US 2008/0191643 A1 Aug. 14, 2008

(51) Int. Cl.
*G09G 3/30* (2006.01)

(52) U.S. Cl.
USPC ..... 345/77; 345/78; 313/463

(58) Field of Classification Search
USPC ..... 345/102, 76–83; 315/300, 312, 169.3; 313/463
See application file for complete search history.

(56) References Cited

U.S. PATENT DOCUMENTS

| | | | |
|---|---|---|---|
| 4,329,625 | A | 5/1982 | Nishizawa et al. |
| 5,783,909 | A | 7/1998 | Hochstein |
| 5,959,316 | A | 9/1999 | Lowery |
| 6,078,148 | A | 6/2000 | Hochstein |
| 6,127,784 | A | 10/2000 | Grossman et al. |
| 6,153,985 | A | 11/2000 | Grossman |
| 6,236,331 | B1 | 5/2001 | Dussureault |
| 6,285,139 | B1 | 9/2001 | Ghanem |
| 6,350,041 | B1 | 2/2002 | Tarsa et al. |
| 6,362,578 | B1 | 3/2002 | Swanson et al. |
| 6,411,046 | B1 | 6/2002 | Muthu |
| 6,441,558 | B1 | 8/2002 | Muthu et al. |
| 6,495,964 | B1 | 12/2002 | Muthu et al. |
| 6,498,440 | B2 * | 12/2002 | Stam et al. ..... 315/291 |
| 6,507,159 | B2 * | 1/2003 | Muthu ..... 315/307 |
| 6,510,995 | B2 | 1/2003 | Muthu et al. |
| 6,576,881 | B2 | 6/2003 | Muthu et al. |
| 6,576,930 | B2 | 6/2003 | Reeh et al. |
| 6,630,801 | B2 | 10/2003 | Schuurmans |
| 6,674,060 | B2 | 1/2004 | Antila |
| 6,741,351 | B2 | 5/2004 | Marshall et al. |
| 6,809,347 | B2 | 10/2004 | Tasch et al. |
| 6,836,081 | B2 | 12/2004 | Swanson et al. |
| 6,841,804 | B1 | 1/2005 | Chen et al. |
| 6,841,947 | B2 | 1/2005 | Berg-johansen |

(Continued)

FOREIGN PATENT DOCUMENTS

| | | | |
|---|---|---|---|
| EP | 1750248 | A2 | 2/2007 |
| JP | 2004519826 | A | 7/2004 |

(Continued)

OTHER PUBLICATIONS

U.S. Appl. No. 11/755,149, filed May 30, 2007, Van De Ven.

(Continued)

*Primary Examiner* — Tom Sheng
(74) *Attorney, Agent, or Firm* — Myers Bigel Sibley & Sajovec, P.A.

(57) ABSTRACT

Provided are systems and methods for controlling a solid state lighting panel. A system according to some embodiments of the invention includes a first microprocessor operative to perform color management data processing and generate emitter control data values. The system also includes a second microprocessor operative to receive the emitter control data values from the first processor to control a plurality of light emitters.

21 Claims, 4 Drawing Sheets

U.S. PATENT DOCUMENTS

| | | | | |
|---|---|---|---|---|
| 6,888,529 | B2 * | 5/2005 | Bruning et al. | 345/102 |
| 6,936,857 | B2 | 8/2005 | Doxsee et al. | |
| 6,952,195 | B2 * | 10/2005 | Arakawa | 345/102 |
| 7,009,343 | B2 | 3/2006 | Lim et al. | |
| 7,023,543 | B2 | 4/2006 | Cunningham | |
| 7,036,956 | B1 | 5/2006 | Chou | |
| 7,135,664 | B2 | 11/2006 | Vornsand et al. | |
| 7,140,752 | B2 | 11/2006 | Ashdown | |
| 7,173,384 | B2 | 2/2007 | Plotz et al. | |
| 7,186,000 | B2 | 3/2007 | Lebens et al. | |
| 7,202,608 | B2 | 4/2007 | Robinson et al. | |
| 7,208,713 | B2 | 4/2007 | Ishiguchi | |
| 7,213,940 | B1 | 5/2007 | Van De Ven et al. | |
| 7,256,557 | B2 | 8/2007 | Lim et al. | |
| 7,317,288 | B2 * | 1/2008 | Lin et al. | 315/291 |
| 7,423,626 | B2 * | 9/2008 | Yamamoto et al. | 345/102 |
| 7,583,035 | B2 * | 9/2009 | Shteynberg et al. | 315/307 |
| 7,675,249 | B2 * | 3/2010 | Furukawa et al. | 315/309 |
| 2002/0190972 | A1 | 12/2002 | Ven de Van | |
| 2003/0089918 | A1 | 5/2003 | Hiller et al. | |
| 2006/0105482 | A1 | 5/2006 | Alferink et al. | |
| 2007/0195224 | A1 | 8/2007 | Chang | |
| 2007/0247414 | A1 | 10/2007 | Roberts | |
| 2008/0111949 | A1 | 5/2008 | Shibata et al. | |
| 2008/0191631 | A1 * | 8/2008 | Archenhold et al. | 315/158 |

FOREIGN PATENT DOCUMENTS

| | | | |
|---|---|---|---|
| JP | 2006-120627 | A | 5/2006 |
| JP | 2006-202602 | A | 8/2006 |
| JP | 2008-034342 | A | 2/2008 |
| WO | WO 2005048659 | A2 | 5/2005 |
| WO | WO 2006006537 | A1 * | 1/2006 |
| WO | WO 2007/032454 | A1 | 3/2007 |
| WO | WO 2007/061758 | A1 | 5/2007 |
| WO | WO 2007/088655 | A1 | 8/2007 |

OTHER PUBLICATIONS

U.S. Appl. No. 12/257,804, filed Oct. 24, 2008, Negley.

Perduijn et al, "Light Output Feedback Solution for RGB LED Backlight Applications", SID 2003 Digest 43.2/A.

Zhu et al., "Optimizing the Performance of Remote Phosphor LED, First International Conference on White LEDs and Solid State Lighting", 5 pages, Japan (Nov. 26-30, 2007).

International Search Report and Written Opinion (9 pages) corresponding to International Application No. PCT/US07/12707; Mailing Date: Aug. 21, 2008.

Extended European Search Report (10 pages) corresponding to European Application No. 09154919.6; Dated: May 8, 2009.

Translation of Japanese Patent Office Action mailed Nov. 11, 2011, Japanese Patent Application No. 2009-550093.

Japanese Office Action Corresponding to Japanese Patent Application No. 2009-550093; Mailing Date: Aug. 3, 2012; Foreign Text, 8 Pages, English Translation Thereof, 8 Pages.

* cited by examiner

SYSTEMS AND METHODS FOR SPLIT PROCESSOR CONTROL IN A SOLID STATE LIGHTING PANEL

FIELD OF THE INVENTION

The present invention relates to solid state lighting, and more particularly, controlling a solid state lighting panel.

BACKGROUND

Solid state lighting arrays are used for many of lighting applications. For example, solid state lighting panels including arrays of solid state lighting devices have been used as direct illumination sources, for example, in architectural and/or accent lighting. A lighting panel may be used, for example, as a backlight unit (BLU) for an LCD display. A solid state BLU may include, for example, a packaged light emitting device including one or more light emitting diodes (LEDs).

LEDs are current-controlled devices in the sense that the intensity of the light emitted from an LED is related to the amount of current driven through the LED. A solid state lighting panel can be configured that can produce, through the use of multiple colors of LEDs and individual intensity control of each color, a variety of color hues. Precise control of color and intensity can involve data intensive and/or iterative processor operations that can require significant processing resources.

One common method for controlling the current driven through the LEDs to achieve desired intensity and color mixing is a Pulse Width Modulation (PWM) scheme. PWM schemes pulse the LEDs alternately to a full current "ON" state followed by a zero current "OFF" state. The ratio of the ON time to the total cycle time is defined as the duty cycle, and, in a fixed cycle frequency, determines the time-average luminous intensity. Varying the duty cycle from 0% to 100% correspondingly varies the intensity of the LED as perceived by the human eye from 0% to 100% because the human eye integrates the ON/OFF pulses into time-average luminous intensity. A processor may be used to generate PWM signals to current drivers.

SUMMARY

A system for controlling a solid state lighting panel having multiple light emitters according to some embodiments of the invention includes at least one current driver configured to selectively provide current to the light emitters. The system also includes a sensor to monitor performance of the light emitters and a color management unit that is responsive to the sensors and is operative to generate color management information to control the light output of the light emitters. The system further includes a first controller operative to perform color management processing in response to the color management information and to generate duty cycle data. A second controller is operative to receive the duty cycle data and to control the at least one current driver.

In other embodiments, the first controller can be further configured to receive a user input such that the first controller adjusts the duty cycle data responsive to the user input.

In further embodiments, a master component can include the first and second controllers and the at least one current driver. A slave component can include at least one other current driver that can be controlled by the second controller on the master component.

In further embodiments, the second controller can also include input logic configured to receive duty cycle data from the first controller.

In yet further embodiments, one of the sensors can be a photo sensor operative to generate a color performance signal and/or a thermal sensor operative to generate a temperature signal.

In other embodiments, the first and second controllers can be microprocessors.

Methods of controlling a solid state lighting panel having multiple solid state light emitters according to some embodiments of the invention include generating emitter control data in a first controller in response to color management information received from the solid state lighting panel. A plurality of solid state light emitters can be controlled by a second controller in response to the emitter control data received from the first controller.

In some embodiments, the emitter control data may be duty cycle data.

Methods may further include grouping the multiple light emitters into multiple emitter strings configured to include a portion of the light emitters electrically coupled in series, driving the multiple emitter strings using multiple current drivers and receiving a plurality of control signals into the plurality of current drivers from the second controller. The driving can include using pulse-width-modulation (PWM) to control the multiple emitter strings.

In yet other embodiments, the first controller can be polled for the emitter control data to be transmitted to the second controller.

Other embodiments can also include transmitting multiple performance signals to a color management unit.

Yet other embodiments can include sensing performance data corresponding to the light emitters. The performance data can include temperature values and/or color performance values corresponding to the light emitters.

Further embodiments can include generating color management information in a color management unit and transmitting the color management information to the first controller.

Still further embodiments can include receiving a user input into the first controller, such that the emitter control data is modified responsive to the user input.

A system for controlling a solid state lighting panel having multiple solid state light emitters according to some embodiments of the invention includes a first microprocessor operative to perform color management data processing responsive to color management information for the solid state light emitters and to generate duty cycle data values and a second microprocessor operative to receive the duty cycle data values from the first processor and to control multiple light emitters.

Some embodiments can also include current drivers operative to receive pulse-width-modulation (PWM) signals from the second microprocessor and selectively provide current to the light emitters.

Other embodiments can include means for sensing display performance values.

Yet other embodiments can include a color management unit configured to receive performance signals, to generate color management information, and to transmit the color management information to the first microprocessor.

In further embodiments, the first microprocessor can be further configured to receive a user input.

In yet further embodiments, the second processor can be configured to poll the first processor for updated duty cycle data.

BRIEF DESCRIPTION OF THE DRAWINGS

The accompanying drawings, which are included to provide a further understanding of the invention and are incorporated in and constitute a part of this application, illustrate certain embodiment(s) of the invention.

DETAILED DESCRIPTION OF EMBODIMENTS OF THE INVENTION

Figure 1:
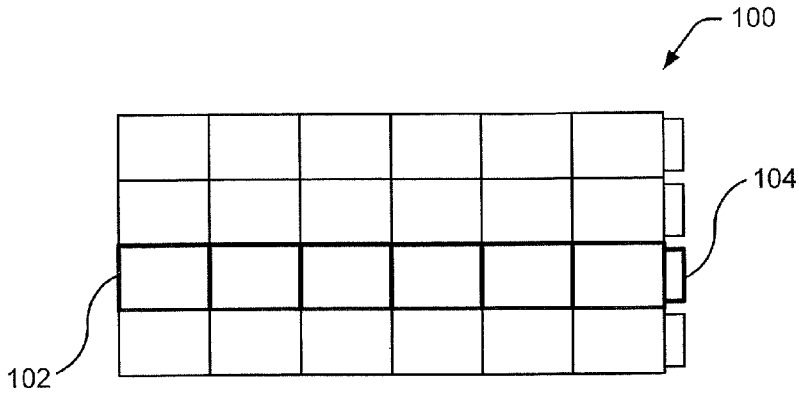
FIG. 1 is a block diagram illustrating a top view of a solid state lighting panel in accordance with some embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will also be understood that when a first element, operation, signal, and/or value is referred to as "responsive to" another element, condition, signal and/or value, the first element, condition, signal, and/or value can exist and/or operate completely responsive to or partially responsive to the other element, condition, signal, and/or value.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Some embodiments of the invention may arise from the recognition that where a processor is tasked with non-PWM processing tasks, interruptions in the cycle of PWM signal generation can occur and degrade the operations of the display. Accordingly, some embodiments split the operations into two separate hardware units. A first controller can be configured to perform the color management operations and to receive and process light emitter performance signals and user input to generate duty cycle data. A second controller can be configured to control the emitter drivers using the duty cycle data. Moreover, in some embodiments, the second controller can be configured to poll the first controller for updated duty cycle data. In this manner, interruptions to the second controller can be reduced. In some embodiments, the communication between the first and second controller may be serial, parallel, and/or interrupt driven.

Reference is now made to FIG. 1, which is a block diagram illustrating a top view of a solid state lighting panel 100 according to some embodiments of the invention. A solid state lighting panel 100 can include multiple solid state lighting bars 102 that can include multiple solid state light emitters, such as light emitting diodes (LEDs). The solid state lighting bars 102 can include a bar electrical interface that is configured to provide electrical interconnection with drivers that can provide current to the LEDs.

Figure 2:
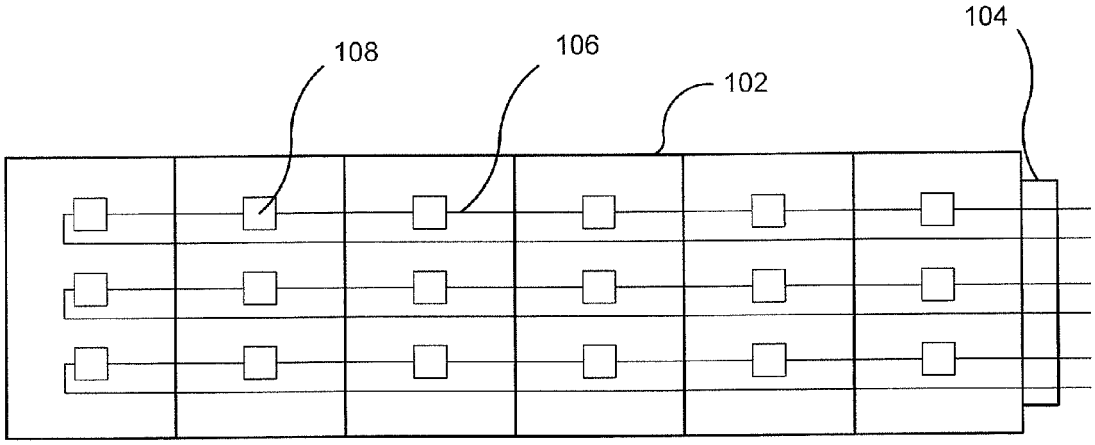
FIG. 2 is a block diagram illustrating a top view of a solid state lighting bar according to some embodiments of the invention.

As illustrated in FIG. 2, which is a block diagram illustrating a top view of a solid state lighting bar 102 according to some embodiments of the invention, each solid state lighting bar 102 can include multiple solid state light emitters 108 that can be arranged in emitter strings 106. The emitter strings 106 can include multiple light emitters 108 electrically coupled in series, for example. The light emitters 108 can include light emitters of different colors including, for example, red, green and blue (RGB). Each solid state lighting bar 102 can include multiple emitter strings 106 that can be independently controlled. In this manner, a solid state lighting bar 102 can include a different emitter string 106 for each color of light emitter 108. In some embodiments, a solid state lighting bar can include more than one string of one or more colors. The color hue of the lighting panel can be controlled by varying the intensities of the different color emitter strings 106. In some embodiments, the emitter strings 106 may employ white LED lighting devices that include a blue-emitting LED coated with a wavelength conversion phosphor that converts some of the blue light emitted by the LED into yellow light. The resulting light, which is a combination of blue light and yellow light, may appear white to an observer.

Figure 3:
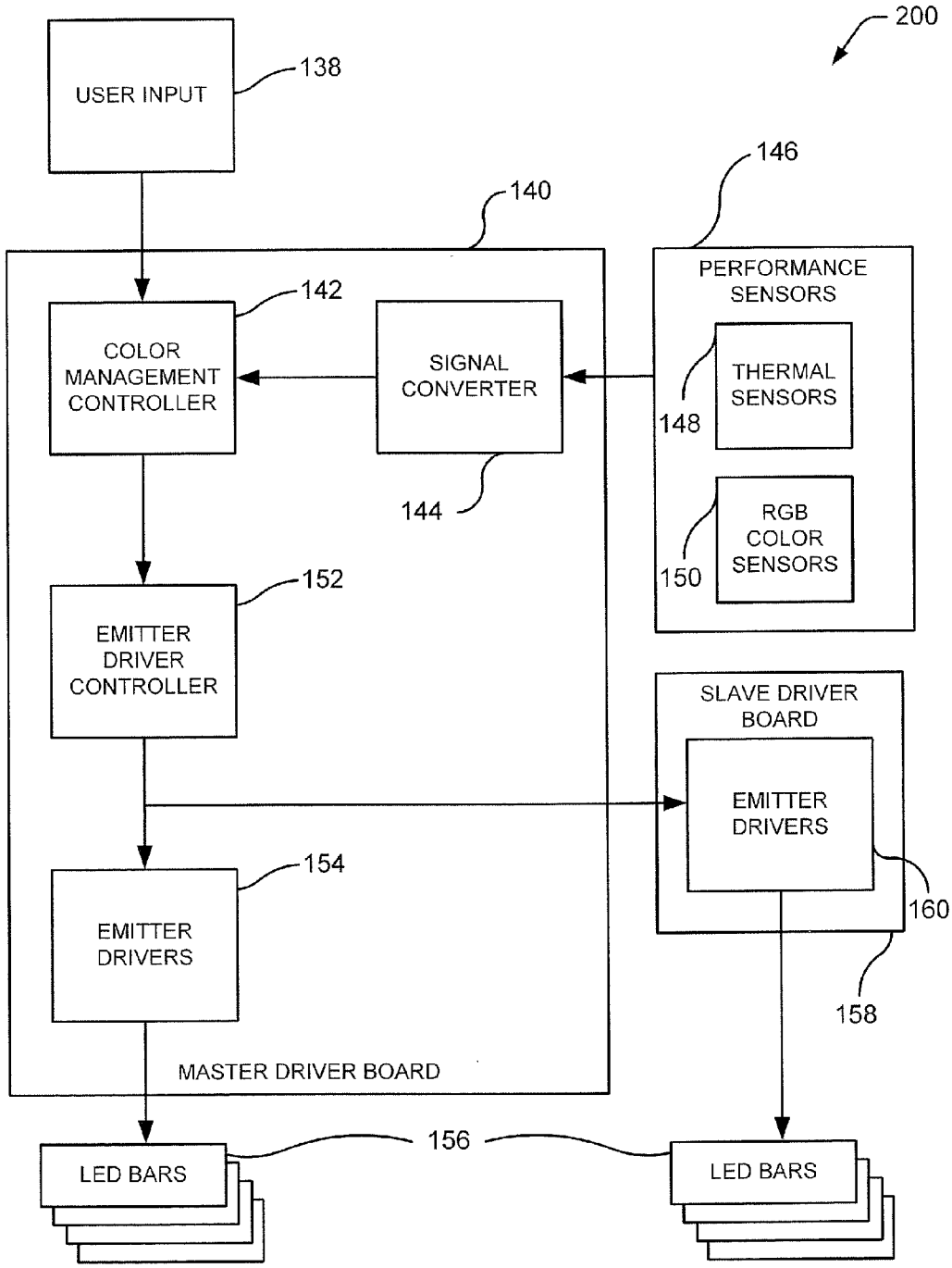
FIG. 3 is a block diagram illustrating systems and methods for controlling a solid state lighting panel in accordance with some embodiments of the invention.

Reference is now made to FIG. 3, which is a block diagram illustrating systems/methods 200 for controlling a solid state lighting panel in accordance with some embodiments of the invention. These systems/methods 200 include a color management controller 142 that can be configured to receive performance signals that can be generated by performance sensors 146. The performance sensors 146 can include, for example, thermal sensors 148 and/or RGB color sensors 150. Other types of sensor are possible, such as, for example, spectrographic and/or electric/magnetic field strength sensors. The thermal sensors 148 can generate signals corresponding to temperatures of individual light emitters and/or groups of light emitters in a solid state lighting panel. Although not illustrated, in some embodiments the thermal sensors 148 may be included on the master driver board 140 and/or one or more slave driver boards 158. The temperature signals can be used to balance the luminous output to provide more uniformity in the intensity of the lighting panel. The RGB sensors 150 can generate signals corresponding to the chromatic output of individual light emitters and/or groups of light emitters. The chromatic signals can be used as a color feedback signal in a lighting panel control system to provide more uniform color output of the lighting panel. These systems/methods 200 can also optionally include a signal converter 144 that is configured to convert a signal having a first format into a signal having a second format. For example, performance sensors 146 may be configured to generate analog signals and the color management controller 142 may be configured to receive signals in a digital format. The signal converter 144 can receive the analog signals from the performance sensors 146 and generate corresponding digitally encoded signals for receipt by the color management controller 142. In some embodiments, the performance sensors 146 may be configured to generate signals in a format that may be directly received by the color management controller 142 without the operation of a signal converter 144.

The color management controller 142 can also be configured to receive user input 138, which can provide control reference signals and/or settings for lighting properties including, but not limited to, intensity and/or color. In this manner, the color management controller 142 can perform the color management processing operations based on the user inputs and the signals from the performance sensors. Based on the results of the color management processing, the color management controller 142 can generate duty cycle data, which can be received by an emitter driver controller 152. In some embodiments, the receipt of the duty cycle data can occur responsive to an interrupt generated by the color management controller 142. An emitter driver controller 152 of other embodiments can be configured to poll the color management controller 142 for updated duty cycle data. In this manner, the operations in the emitter driver controller 152 can be less susceptible to interruption, thereby potentially improving the display operations.

The emitter driver controller 152 can be configured to provide Pulse-Width-Modulation (PWM) signals to emitter drivers 154. Responsive to the PWM signals from the emitter driver controller 152, the emitter drivers 154 provide current to the LEDs in the LED bars 156 according to the duty cycle data that is generated in the color management controller 142. Since the processing requirements for the color management operations are addressed independent of the processing requirements for generating PWM signals, the emitter driver controller 152 can perform without interruptions that might otherwise occur during significant color management processing tasks.

Systems/methods 200 having a large quantity of light emitters may use a master driver board 140 and one or more slave driver boards 158. The master driver board 140 may be configured to perform color management processing and/or PWM operations. The PWM signals can be transmitted from the emitter driver controller 152 to the emitter drivers 160 on a slave driver board 158, which is connected to other LED bars 156. Some embodiments can include slave driver boards 158 that include substantially similar functionality as the master driver board 140, such that a slave driver board 158 is a slave by virtue of designation and/or selection. Some embodiments may provide that the emitter drivers 154, 160 are collocated on a single driver board that may be distinct from master driver board 140 that includes the color management controller 142 and the emitter driver controller 152.

Figure 4:
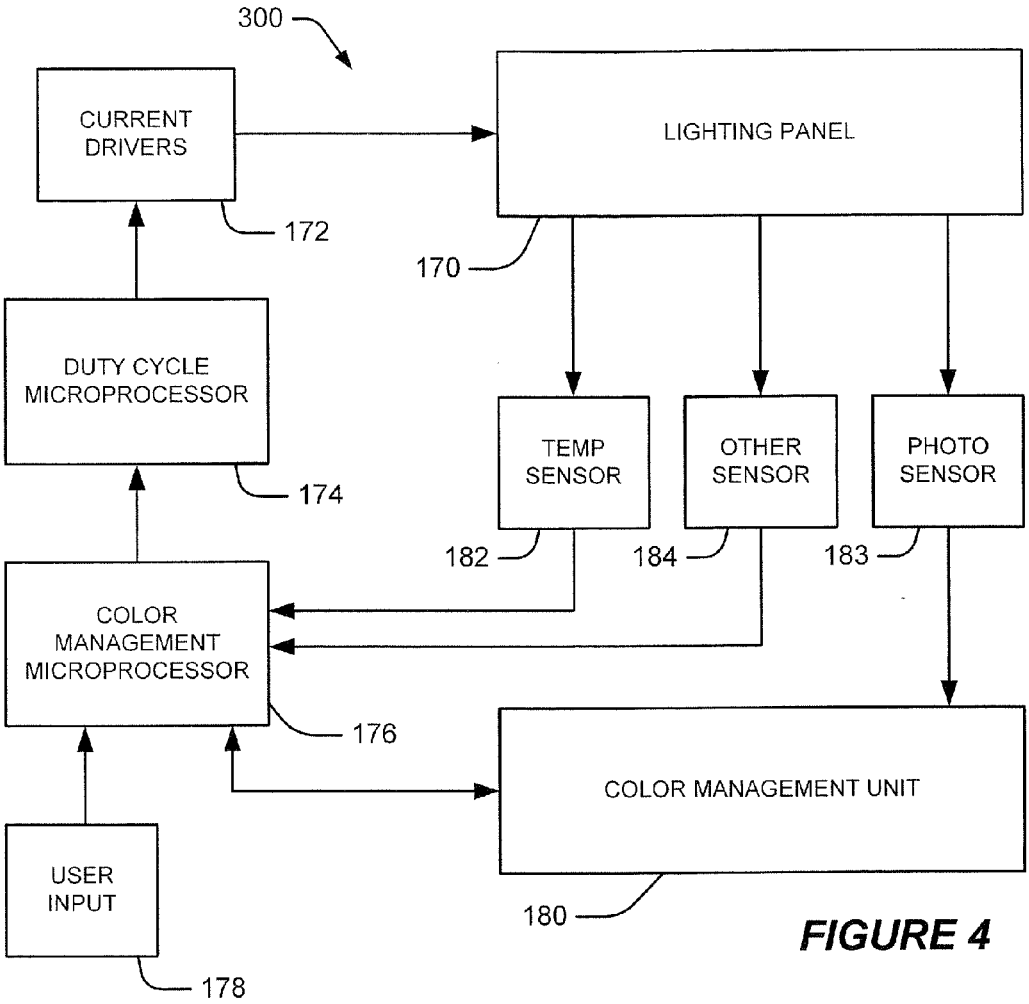
FIG. 4 is a block diagram illustrating systems and methods for controlling a solid state lighting panel in accordance with other embodiments of the invention.

Reference is now made to FIG. 4, which is a block diagram illustrating systems/methods for controlling a solid state lighting panel in accordance with other embodiments of the invention. Systems/methods 300 can include a lighting panel 170 that can include multiple light emitters (not shown). The light emitters illuminate in varying levels of intensity as a function of current that is supplied by current drivers 172, which receive signals from a duty cycle microprocessor 174.

The duty cycle microprocessor 174, which, in some embodiments, can correspond to the emitter driver controller 152 of FIG. 3, can use a variety of schemes for controlling the light emitter output including PWM, Frequency Modulation (FM), and/or Analog Control, among others.

The duty cycle microprocessor 174 can receive duty cycle data from a color management microprocessor 176, which can receive color management information from a color management unit 180 and/or a user input 178. The color management microprocessor 174 of some embodiments can correspond to the color management controller 142 of FIG. 3. Using the processing resources of the color management microprocessor 176, the color management unit 180 can perform complex intensity and/or color hue calculations based, in part, on inputs received from panel photo sensors 183, which, in some embodiments, can correspond to performance sensors 146 of FIG. 3. Photo sensors 183 can be used to provide chromatic data, such as RGB data corresponding to individual light emitters and/or groups of light emitters. The color management microprocessor 176 may be configured to receive inputs from temperature sensors 182 and other sensors 184 to perform processing tasks related to color management. For example, temperature sensors 182 can be used to provide temperature data corresponding to individual light emitters and/or groups of light emitters. Additionally, other performance conditions can be determined using other sensors 184 corresponding to individual light emitters and/or groups of light emitters. User inputs 178 can also be received by the color management microprocessor 176 for generating the duty cycle data for the duty cycle microprocessor 174.

By performing the color management processing in a color management microprocessor 176, the duty cycle microprocessor 174 can be substantially dedicated to providing the PWM or other type of control signals to the current drivers 172. The duty cycle data can be transmitted to the duty cycle microprocessor 174 based on an interrupt sent by the color management processor 176 or other related system device. In some embodiments, the duty cycle microprocessor 174 can poll the color management microprocessor 176 for updated duty cycle data. Yet other embodiments can include, for example, a memory location that can be written to by the color management microprocessor 176 and read from by the duty cycle microprocessor 174.

Figure 5:
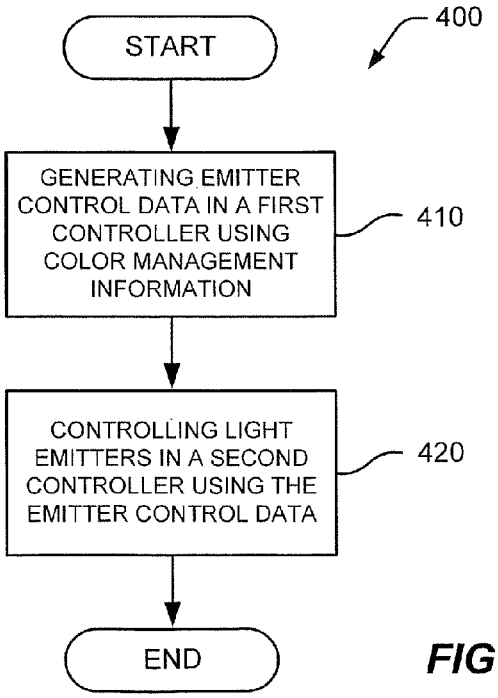
FIG. 5 is a flow diagram illustrating operations for controlling a solid state lighting panel according to some embodiments of the invention.

Reference is now made to FIG. 5, which is a flow diagram illustrating operations for controlling a solid state lighting panel according to some embodiments of the invention. The operations 400 can include generating emitter control data in a first controller using color management information (block 410). The color management information can be received from a color management unit that can generate the color management information to control the light output of light emitters in a solid state lighting panel. The color management unit may receive sensor inputs corresponding to temperature, color and/or other panel performance characteristics. The first controller can use the color management information to generate updated values of PWM emitter control data for controlling the light emitters. In some embodiments, the emitter control data may be duty cycle data, current level data, and/or voltage level data. In some embodiments, operations can also include modifying the emitter control data in response to a user input received into the first controller.

The operations 400 can also include controlling light emitters with a second controller using the emitter control data (block 420). The second controller can use the emitter control data to control current drivers in accordance with the emitter control information provided by the first controller. The drivers can be, for example, field-effect-transistors (FETs) and can receive control signals from the second controller in order to provide current to the light emitters. In some embodiments the first and second controllers can be processors, such as microprocessors. By allocating the first controller for generating the emitter control data from received user input and the color management information, the second processor can be relieved of processing those interrupts. In this manner, in some embodiments, the second controller may experience reduced interruption from the user input and color management information.

Figure 6:
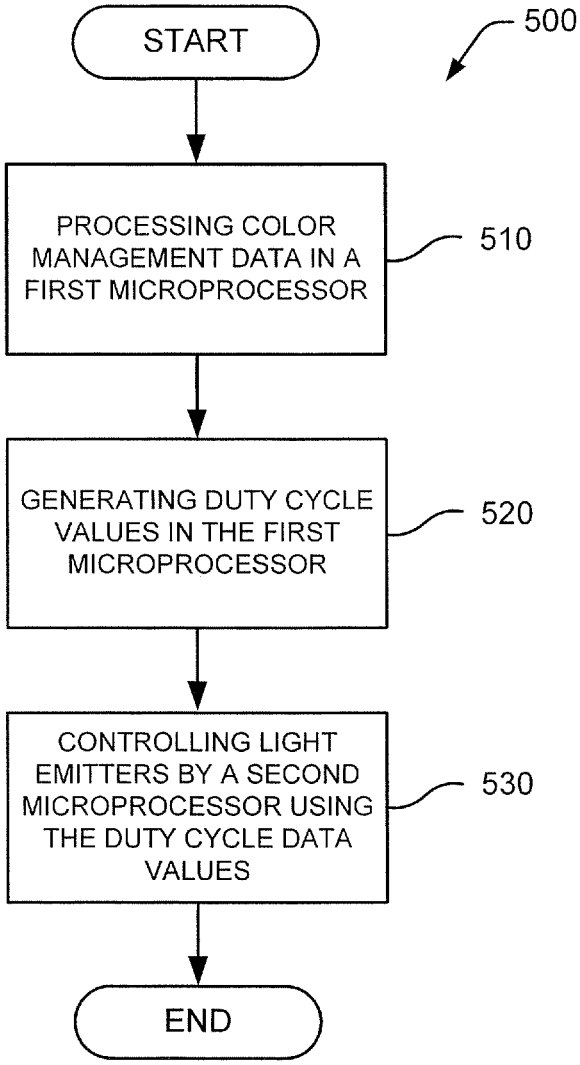
FIG. 6 is a flow diagram illustrating operations for controlling a solid state lighting panel according to other embodiments of the invention.

Reference is now made to FIG. 6, which is a flow diagram illustrating operations 500 for controlling a solid state lighting panel according to other embodiments of the invention. The operations 500 include processing color management data in a first microprocessor (block 510). The color management processing can be used to process color management information that can be received from a color management unit. The color management unit may receive sensor inputs corresponding to temperature, color and/or other panel performance characteristics. The operations 500 can also include generating duty cycle values in the first microprocessor (block 520). In some embodiments, the duty cycle values can depend on inputs received from a user. The duty cycle values can be updated values of PWM duty cycle data for controlling the light emitters.

The operations 500 can also include controlling light emitters in a second microprocessor using the duty cycle values generated by the first microprocessor (block 530). The second microprocessor can use the duty cycle data to control current drivers in accordance with the duty cycle information provided by the first microprocessor. The drivers can receive control signals from the second controller in order to provide current to the light emitters.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A system for controlling a solid state lighting panel including a plurality of light emitters, the system comprising:

at least one current driver operative to selectively provide current to the plurality of light emitters;

a plurality of sensors operative to monitor performance of the plurality of light emitters;

a color management unit that is responsive to a first portion of the plurality of sensors and is operative to generate color management information that includes intensity and/or color hue information from corresponding intensity and/or color hue calculations;

a first controller operative to perform color management processing in response to a second portion of the plurality of sensors and the color management information and to generate duty cycle data; and a second controller operative to receive the duty cycle data and to control the at least one current driver; wherein the first portion of the plurality of sensors are operable to provide chromatic data and the second portion of the plurality of sensors are operable to provide non-chromatic data.

2. The system of claim 1, wherein the first controller is further configured to generate the duty cycle data responsive to a user input.

3. The system of claim 1, further comprising:

a master component comprising the first controller, the second controller, and the at least one current driver; and a slave component comprising at least one other current driver, wherein the second controller is operative to control the duty cycle of the at least one other current driver.

4. The system of claim 1, wherein the second controller further comprises input logic configured to receive the duty cycle data from the first controller.

5. The system of claim 1, wherein one of the plurality of sensors comprises a photo sensor operative to generate a color performance signal for at least one of the plurality of light emitters.

6. The system of claim 1, wherein the plurality of sensors comprises a plurality of thermal sensors operative to generate a plurality of temperature signals for subsets of and/or individual ones of the plurality of light emitters.

7. The system of claim 1, wherein the first controller comprises a first microprocessor and wherein the second controller comprises a second microprocessor.

8. A method of controlling a solid state lighting panel including a plurality of solid state light emitters, comprising:

transmitting a plurality of performance signals corresponding to thermal and color performance data of the plurality of solid state light emitters to a color management unit, generating color management information including intensity and/or color hue information in the color management unit using intensity and/or color hue computations;

transmitting the color management information from the color management unit to the first controller;

generating emitter control data in a first controller in response to color management information received from the solid state lighting panel; and controlling the plurality of solid state light emitters by a second controller responsive to the emitter control data received from the first controller, wherein the thermal performance data includes a plurality of temperature values corresponding to subsets and/or individual ones of the plurality of solid state light emitters, respectively; and wherein the color performance data includes a plurality of color performance values corresponding to subsets and/or individual ones of the plurality of light emitters, respectively.

9. The method of claim 8, wherein the emitter control data comprises duty cycle data.

10. The method of claim 8 further comprising:

grouping the plurality of solid state light emitters into a plurality of emitter strings configured to include a portion of the plurality of light emitters electrically coupled in series;

driving the plurality of emitter strings using a plurality of current drivers; and receiving a plurality of control signals into the plurality of current drivers from the second controller.

11. The method of claim 10, wherein the driving comprises generating pulse-width-modulation (PWM) to control the plurality of emitter strings.

12. The method of claim 8, further comprising polling the first controller for the emitter control data to be transmitted to the second controller.

13. The method of claim 8, further comprising transmitting a plurality of performance signals for the solid state light emitters to a color management unit.

14. The method of claim 8, further comprising sensing, for receipt by the first controller, performance data of the plurality of solid state light emitters.

15. The method of claim 8, further comprising receiving a user input into the first controller, wherein the emitter control data is selectively modified responsive to the user input.

16. A system for controlling a solid state lighting panel including a plurality of solid state light emitters, the system comprising:

a color management unit that is operative to receive a plurality of performance signals that correspond to thermal and color performance data of the plurality of solid state light emitters, to generate color management information including intensity and/or color hue information by performing intensity and/or color hue computations, and to transmit the color management information to the first microprocessor;

a first microprocessor operative to perform color management data processing responsive to color management information for the plurality of solid state light emitters and to generate a plurality of duty cycle data values; and a second microprocessor operative to receive the plurality of duty cycle data values from the first processor and to control the plurality of solid state light emitters, wherein the thermal performance data includes a plurality of temperature values corresponding to subsets and/or individual ones of the plurality of solid state light emitters, respectively; and wherein the color performance data includes a plurality of color performance values corresponding to subsets and/or individual ones of the plurality of light emitters, respectively.

17. The system of claim 16, further comprising a plurality of current drivers operative to receive a plurality of pulse-width-modulation (PWM) signals from the second microprocessor and selectively provide current to the plurality of light emitters.

18. The system of claim 17, wherein the color management data processing is independent of processing corresponding to generating the PWM signals.

19. The system of claim 16, further comprising means for sensing display performance values.

20. The system of claim 16, wherein the first microprocessor is further configured to receive a user input and to modify the plurality of duty cycle data values.

21. The system of claim 16, wherein second processor is configured to poll the first processor for updated duty cycle data.

* * * * *